US007412869B2

(12) United States Patent
Kato

(10) Patent No.: US 7,412,869 B2
(45) Date of Patent: Aug. 19, 2008

(54) SELF-PIERCING RIVET FASTENING DEVICE WITH IMPROVED DIE

(75) Inventor: Toru Kato, Toyohashi (JP)

(73) Assignee: Newfrey LLC, Newark, DE (US)

( * ) Notice: Subject to any disclaimer, the term of this patent is extended or adjusted under 35 U.S.C. 154(b) by 415 days.

(21) Appl. No.: 11/166,178

(22) Filed: Jun. 27, 2005

(65) Prior Publication Data

US 2006/0016056 A1 Jan. 26, 2006

(30) Foreign Application Priority Data

Jul. 7, 2004 (JP) ..... 2004-200542

(51) Int. Cl.
*B21J 13/00* (2006.01)

(52) U.S. Cl. ..... 72/462; 72/466.5; 29/432.2

(58) Field of Classification Search ..... 72/412, 72/414, 462, 466.4, 466.5, 476; 29/243.53, 29/525.01, 525.06, 524.1, 432.2, 798; 411/501, 411/502, 503; 470/191

See application file for complete search history.

(56) References Cited

U.S. PATENT DOCUMENTS

| | | | | |
|---|---|---|---|---|
| 4,040,282 | A * | 8/1977 | Saunders | 72/41 |
| 5,752,305 | A | 5/1998 | Cotterill et al. | 29/432.2 |
| 6,269,671 | B1 * | 8/2001 | Zeiter et al. | 72/347 |
| 6,546,613 | B2 * | 4/2003 | Donovan | 29/524.1 |
| 6,842,962 | B1 * | 1/2005 | Blacket | 29/509 |
| 6,962,469 | B2 * | 11/2005 | Wang et al. | 411/82 |
| 2004/0010903 | A1 | 1/2004 | Edwards | |

FOREIGN PATENT DOCUMENTS

| | | |
|---|---|---|
| JP | 8505087 | 6/1996 |

* cited by examiner

*Primary Examiner*—Edward Tolan
(74) *Attorney, Agent, or Firm*—Ajay Gambhir; Stephen R. Valancius

(57) ABSTRACT

A self-piercing rivet fastening device has a punch that drives legs of the rivet into portions of workpieces that are forced into a die cavity, in order to join the workpieces. Particular surfaces of the die cavity are modified to increase the coefficient of friction in order to prevent tips of the legs of the rivet from breaking through a workpiece adjacent to the die and forming holes.

7 Claims, 8 Drawing Sheets

SELF-PIERCING RIVET FASTENING DEVICE WITH IMPROVED DIE

CROSS-REFERENCE TO RELATED APPLICATION

This application claims the benefit of Japanese Application No. 2004-200542 filed Jul. 7, 2004, incorporated herein by reference.

BACKGROUND OF THE INVENTION

The present invention relates to a device for driving a self-piercing rivet into a plurality of components to be fastened, and more particularly to an improved die from such a device.

Self-piercing rivets are frequently used to fasten together aluminum body panels that are unfit for welding. Automotive panels are increasingly being made of aluminum to reduce the overall weight of automobiles, and demand for self-piercing rivets is growing.

An example of a self-piercing rivet fastening device is described in U.S. Pat. No. 5,752,305 issued May 19, 1998, corresponding to Japanese Examined Patent Application Publication No. 8-505087 (Patent Document 1). FIG. 1 and FIG. 2 are drawings of the self-piercing rivet fastening device described in Patent Document 1, and of a self-piercing rivet fastening two components together. As shown in FIG. 1, the two components 5, 6 are clamped with strong force (see the arrows) by the die 2 and nose 3 of the self-piercing rivet fastening device 1, and the self-piercing rivet 9 is driven into the components 5, 6 by the punch 7. The self-piercing rivet 9 has a large-diameter head 10 and tubular legs 11 below the head 10. The components 5, 6 are clamped on the die 2, and the self-piercing rivet 9 is driven into the components 5, 6 by the punch 7.

As shown in FIG. 2, when the self-piercing rivet 9 is properly driven into the components 5, 6, the legs 11 pierce the components 5, 6 and are deformed so that the tips 13 of the legs 11 spread outward, but do not break through the component 6 adjacent to the die 2. The components 5, 6 are thus connected together by the spread legs 11 inside the component 6 and by head 10 of the rivet.

When self-piercing rivets pierce the component 5 adjacent to the punch and pierce, but do not break through, the component 6 adjacent to the die 2, rivet-pierced holes are not formed in the surface of the component 6. Therefore, the sealing properties of the component 6 are not damaged, and the external appearance of the component remains unmarred. However, the legs on the self-piercing rivets may break through the component adjacent to the die and open small holes if that component is not sufficiently thick (e.g., insufficient plate thickness of an automotive body panel).

BRIEF DESCRIPTION OF THE INVENTION

An object of the present invention is to prevent the legs of a self-piercing rivet from opening a hole or holes in a fastened component adjacent to a die by ensuring that the legs come to rest inside that component, even when that component is a thin plate. A plurality of components can be fastened together using self-piercing rivets without the legs of the self-piercing rivets breaking through the component adjacent to the die. (The fastened components are not limited to two in number. Three or more can also be used.)

The present inventor conducted several studies to determine why holes are opened by legs of self-piercing rivets.

Dies have a cavity for receiving a portion of fastened components forced outward by a self-piercing rivet driven in by a punch. The single cause of hole opening was found to be slippage between a fastened component and the cavity surface in the die when a fastened component driven by the punch was pushed into the die and deformed inside the cavity. The tips of the spread legs of a self-piercing rivet are especially likely to break through and form holes when the fastened component adjacent to the die is a body panel with press molding oil adhering to it. This causes the body panel to easily slip inside the die cavity, so that proper leg deformation does not occur.

The aforesaid U.S. Pat. No. 5,752,305 discloses a self-piercing riveting method and apparatus in which a punch of a riveting tool is surrounded by a preclamping element having an annular clamping surface for urging two overlapping sheets against a die. The annular clamping surface may have a rough finish provided, for example, by knurling or annular grooving in order to improve the grip on the sheet material and prevent material being pulled laterally into the joint. A coining ring may be provided on the annular clamping surface to prevent material flow and to regulate distortion adjacent to the rivet head. The self-piercing riveting method and apparatus uses a die having an annular clamping surface which may be roughened in the same way as the annular clamping surface of the punch preclamping element.

The present inventor discovered that roughening particular surface portions of the die cavity is effective in preventing legs of a self-piercing rivet from breaking through a fastened component adjacent to the die.

In one non-limiting embodiment of the present invention, a plurality of uneven (roughened) portions are formed on the inclined surface of a die protrusion to increase the coefficient of friction, so that when contact is made with a fastened component, spread legs of a rivet do not break through the component adjacent to the die. By virtue of the invention, slippage is prevented or substantially reduced inside the die cavity even if press molding oil has adhered to fastened components such as body panels, and the fastened components are deformed properly along the shape of the cavity. This keeps the legs of a self-piercing rivet from opening a hole or holes in one of the fastened components and helps the legs remain inside the fastened component adjacent to the die, even when that component is thin.

The unevenness in the die surface can be made by surface roughness in the form of streaks, and the streaks can be formed so as to extend in a direction preventing slippage of the fastened components.

If the cavity of the die has a bottom surface with a substantially flat portion, a plurality of uneven (roughened) portions can be formed in the entire flat portion of the bottom surface to increase the coefficient of friction. Slippage is prevented or reduced inside the cavity even if press molding oil has adhered to fastened components such as body panels, and the fastened components are deformed properly along the shape of the cavity. This keeps the legs of a self-piercing rivet from opening a hole or holes in one of the fastened components and helps the legs remain inside the fastened component adjacent to the die, even when that component is thin.

The unevenness (e.g., surface roughness) can be created using lathe or electric discharge processing. Although the unevenness preferably covers the inclined surface of a die protrusion or bottom surface of a die cavity, it can also be formed over less than the entire inclined or bottom surface, partially or sporadically.

BRIEF DESCRIPTION OF THE DRAWINGS

The invention will be further described in conjunction with the accompanying drawings, which illustrate preferred (best mode) embodiments, and wherein:

FIG. 1 is a cross-sectional view of fastened components clamped between a punch and a die of a self-piercing rivet fastening device of the prior art before the self-piercing rivet is driven in;

DETAILED DESCRIPTION OF THE INVENTION

Figure 3:
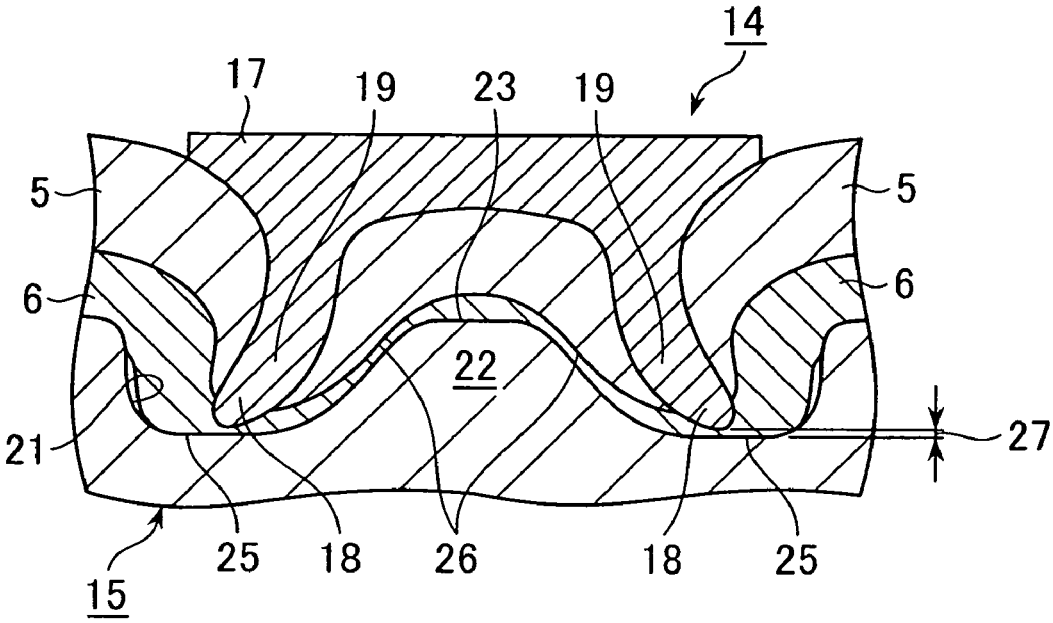
FIG.3 (PRIOR ART)
FIG. 3 is a cross-sectional view of a self-piercing rivet driven into fastened components using a die of the prior art.

A die in an embodiment of a self-piercing rivet fastening device of the present invention will now be explained with reference to FIG. 4 through FIG. 10 and in comparison to a die of the prior art. In FIG. 3, 14 denotes a conventional self-piercing rivet and 15 denotes a die of the prior art. The self-piercing rivet 14 has a head 17 and legs 19 whose tips 18 become deformed when driven into components 5, 6 by a punch (not shown) so as to spread the legs outward radially. The die 15, which may be made of tool steel, for example, has a cavity 21 for receiving portions of the fastened components 5, 6 forced outward by the legs 19 of the self-piercing rivet 14 driven in by the punch. The cavity 21 has a protrusion 22 at its center protruding towards the punch. The protrusion 22 has a substantially flat top 23 and an inclined surface portion 26 between the top 23 and the bottom surface 25 of the cavity. The inside surface of the cavity 21, the top 23 of the protrusion 22, the inclined surface 26, and the bottom surface 25 of the cavity in the die 15 of the prior art are all machined smooth.

When components 5, 6 are fastened together using a die 15 of the prior art, the tips 18 of the legs of the self-piercing rivet 15 pierce the fastened components and are deformed inside the cavity. The thickness 27 (remaining thickness) of the fastened components 5, 6 between the tips 18 of the legs and the bottom surface 25 of the cavity is extremely small. As a result, the legs can break through the component adjacent to the die and form holes. If the fastened components are automotive body panels with press molding oil adhering to them or if the inner surface of the cavity 21 has been machined to make it smooth, the fastened components 5, 6 are likely to slip on the inner surface of the cavity 21 (especially the fastened component 6 adjacent to the die 15). The portion of the fastened components deformed by the tips 18 of the legs of the self-piercing rivet 14 slip, and the remaining workpiece thickness 27 cannot be maintained in a predetermined desired range.

Figure 4:
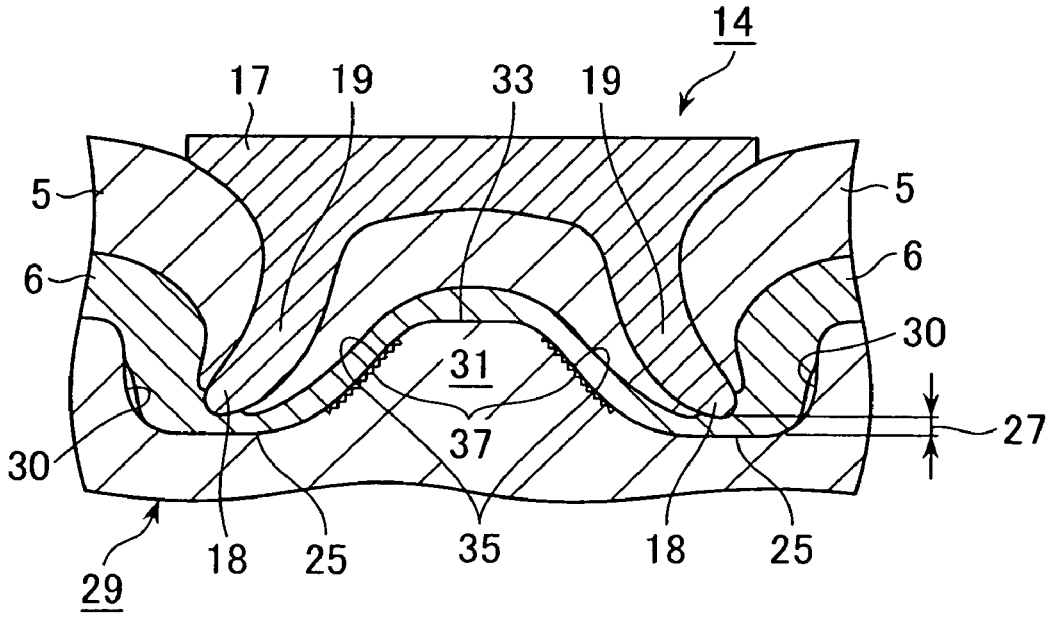
FIG. 4 is a cross-sectional view of a self-piercing rivet driven into fastened components using a die of the present invention.

FIG. 4 shows a conventional self-piercing rivet 14, and a die 29 like the die 15, but modified in accordance with a first example of the present invention. In FIG. 4, the die 29 has a cavity 30 for receiving portions of the fastened components 5, 6 forced out by the legs 19 of self-piercing rivet 14 driven in by a punch (not shown). The cavity 30 has a protrusion 31 at its center, protruding towards the punch. The protrusion 31 has a top 33 that is substantially flat, and an inclined surface 35 between the top 33 and the bottom surface 25 of the cavity. In accordance with the invention, the die 29 also has multiple uneven portions 37 formed, as shown, by surface roughness on the inclined surface 35, to increase the coefficient of friction.

The unevenness of the portions 37 may be in the form of streaks that extend in a direction that prevents slippage of the fastened components when a self-piercing rivet 14 is driven into the fastened components 5, 6. The uneven portions 37 can take a different form, however. For example, horizontal and vertical grooves can be formed to create rows of raised sections in a matrix or random pattern. Whatever the case, the uneven portions 37 should be formed in a pattern or arrangement that increases the friction between particular portions of the inner surface of the die 29 and the fastened component 6 near the die. Fine unevenness can be achieved using lathe or electric discharge processing, for example. As shown in FIG. 4, the remaining workpiece thickness 27 can be maintained substantially greater than that shown in FIG. 3.

Figure 1:
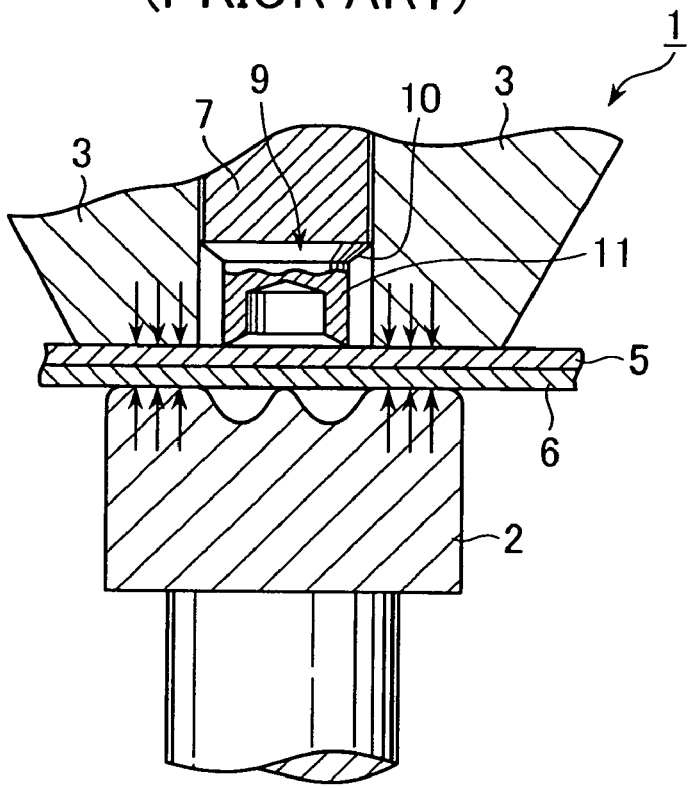
FIG.1 (PRIOR ART)
Figure 2:
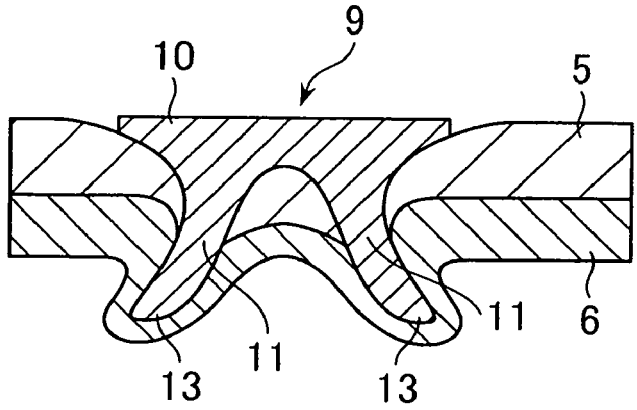
FIG.2 (PRIOR ART)
FIG. 2 is a cross-sectional view of a self-piercing rivet properly driven into fastened components.
Figure 5:
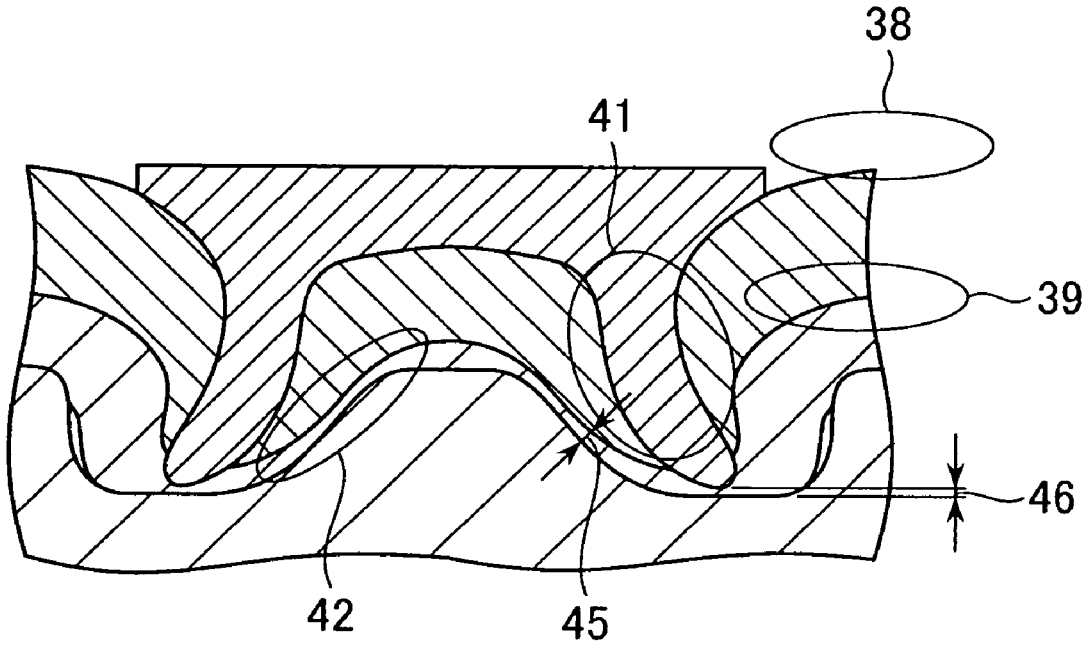
FIG. 5 is a cross-sectional view of a self-piercing rivet driven into fastened components and designating portions considered for an increased coefficient of friction for a die with a central protrusion.

The present inventor performed a simulation in which the coefficient of friction (μ) was increased in various sections from 0.1 to 0.3 to prevent slippage of the fastened components 5, 6 inside the die cavity. In this test, the inventor set out to determine whether he could maintain the thickness of the fastened component 6 in these sections after deformation, and to determine the remaining workpiece thickness between the tips of the legs of the self-piercing rivet and the bottom surface of the die cavity. As indicated in FIG. 5, the coefficient of friction (μ) was increased in the clamped portion 38 where the fastened component 5 at the punch end was clamped by the nose of the self-piercing rivet fastening device (see nose 3 in FIG. 1), the workpiece-to-workpiece portion 39 between the clamped fastened components 5, 6, the rivet-to-workpiece portion 41 between the fastened component 5 and the legs of the rivet, and the die-to-workpiece portion 42 between the die and the fastened components.

Figure 6:
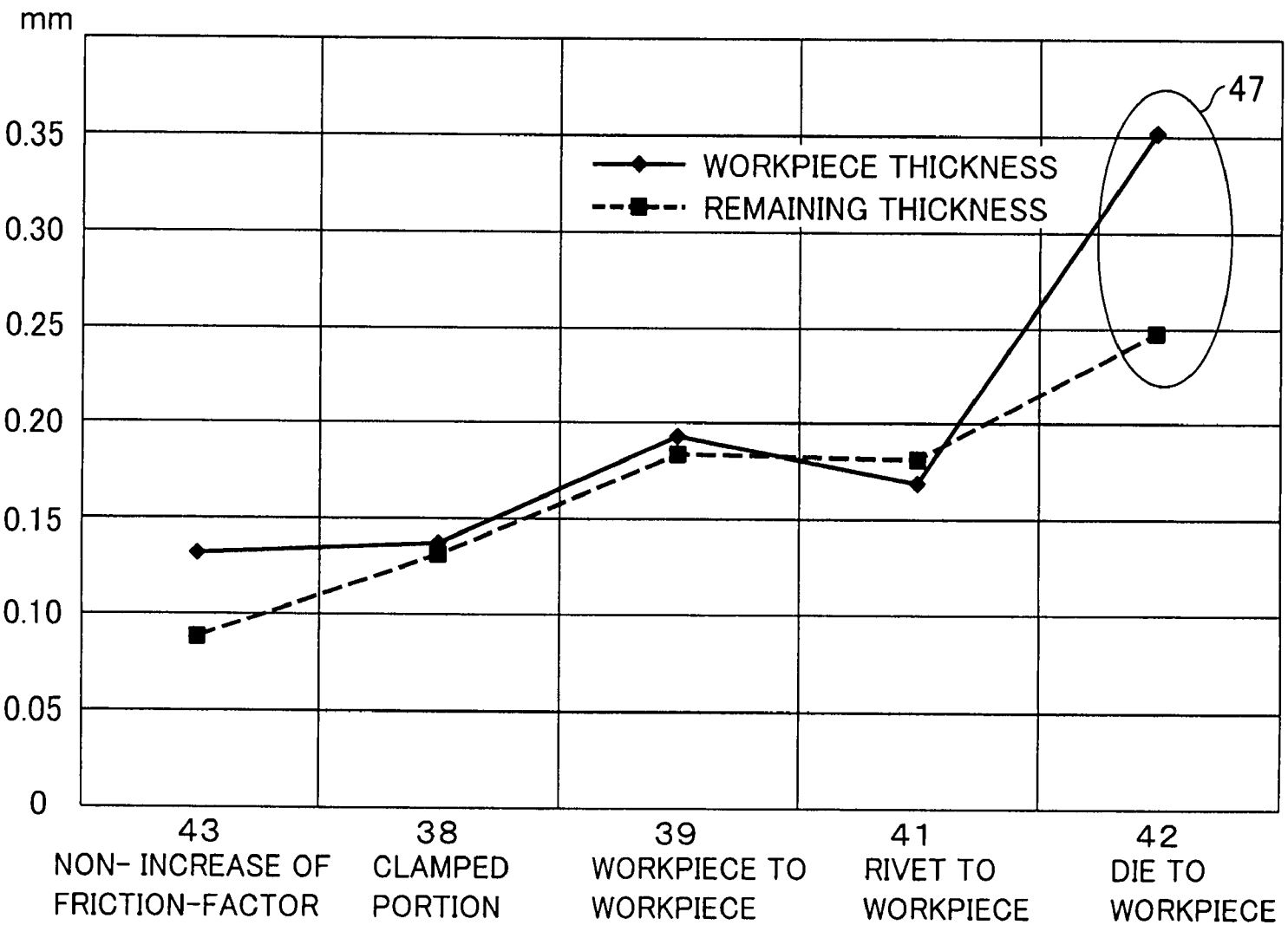
FIG. 6 is a graph showing workpiece thickness and remaining thickness of fastened components corresponding to portions in FIG. 5.

FIG. 6 is a graph showing the workpiece thickness of the fastened component 6 after deformation (line with diamond shapes) and the remaining workpiece thickness (line with square shapes) at the portion without any increase in the coefficient of friction 43, the clamped portion 38, the workpiece-to-workpiece portion 39, the rivet-to-workpiece portion 41, and the die-to-workpiece portion 42 (inclined surface of the die protrusion). The thickness of the fastened component 6 after deformation is denoted by 45 in FIG. 5, and the remaining workpiece thickness is denoted by 46 in FIG. 5. It is clear from portion 47 in FIG. 6 that the thickness of the fastened component 6 after deformation (line with diamond shapes) and the remaining workpiece thickness (line with square shapes) were sufficiently maintained in the die-to-workpiece portion 42. In other words, the present inventor discovered that it was most effective to increase the coefficient of friction of the portion 42 of the die.

Figure 7:
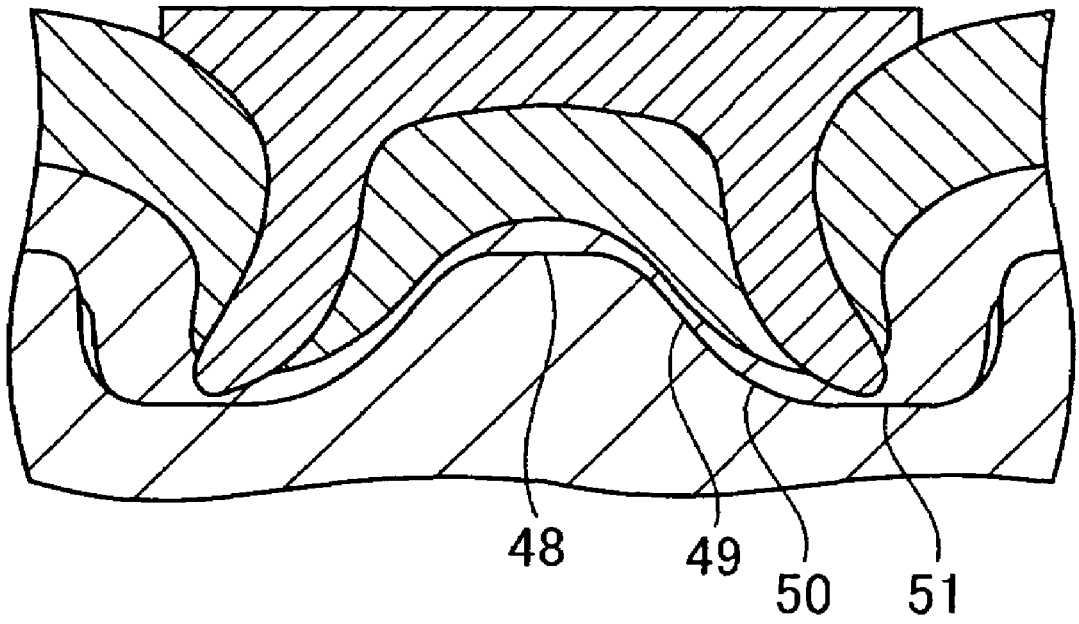
FIG. 7 is a cross-sectional view of a self-piercing rivet driven into fastened components and designating portions considered for an increased coefficient of friction.

Next, the present inventor performed another simulation in which the coefficient of friction (μ) was increased in various sections of the fastened component 6 and the protrusion inside the cavity from 0.1 to 0.3. In this test, the inventor set out to determine whether he could maintain the workpiece thickness of the fastened component 6 in these sections after deformation and to determine the remaining workpiece thickness between the tips of the legs of the self-piercing rivet and the bottom surface of the cavity. As shown in FIG. 7, the coefficient of friction (μ) was increased in the portion at the top portion 48 of the protrusion, the inclined surface portion 49 of the protrusion, the interface portion 50 between the inclined surface portion and the bottom surface of the cavity, and the flat bottom surface portion 51 of the cavity.

Figure 8:
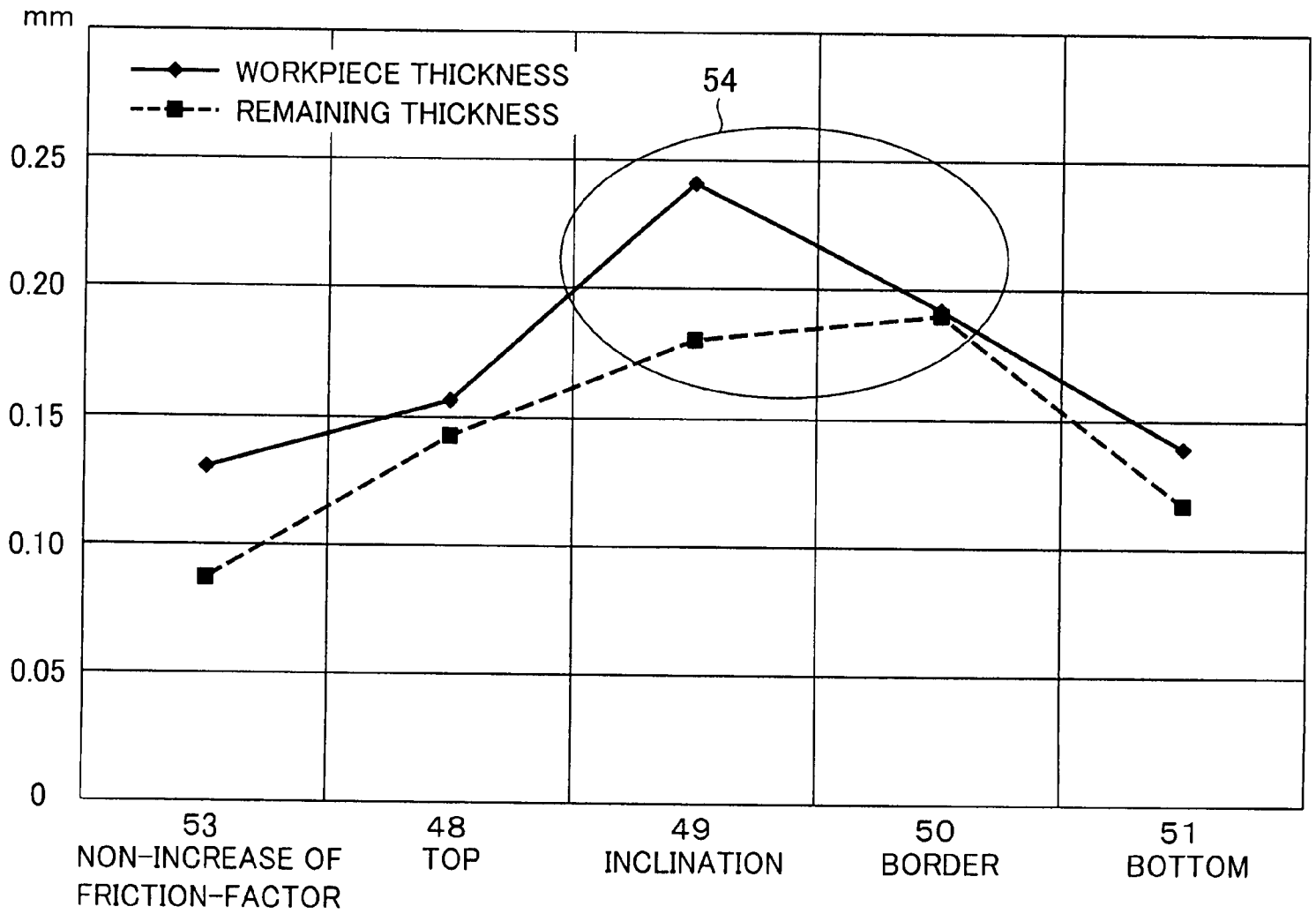
FIG. 8 is a graph showing workpiece thickness and remaining thickness of fastened components corresponding to the portions in FIG. 7.

FIG. 8 is a graph showing the workpiece thickness of the fastened component 6 after deformation (line with diamond shapes) and the remaining workpiece thickness (line with square shapes) at the portion without any increase in the coefficient of friction 53, the top portion 48, the inclined surface portion 49, the interface portion 50, and the bottom surface portion 51 of the cavity. The thickness of the fastened component 6 after deformation is denoted by 45 in FIG. 5, and the remaining workpiece thickness is denoted by 46 in FIG. 5.

It is clear from portion 54 in FIG. 8 that the workpiece thickness of the fastened component 6 after deformation (line with diamond shapes) and the remaining workpiece thickness (line with square shapes) were sufficiently maintained in the inclined surface portion 49, and that the interface portion 50 can also be used to improve the results. In other words, referring to FIG. 4, the present inventor discovered that it was most effective to increase the coefficient of friction on the inclined surface portion 35 by forming unevenness 37. If unevenness 37 is formed on the inclined surface portion 35, outward radial movement of the fastened component 6 can be prevented inside the cavity 30 of the die 29 when the rivet is driven in. This is believed to be the reason why sufficient remaining workpiece thickness can be maintained. Because the coefficient of friction is increased, slippage is prevented or minimized inside the die cavity, and the fastened component is deformed correctly along the shape of the cavity even when press molding oil is adhering to a fastened component such as a body panel. Thus, the legs of a self-piercing rivet are prevented from opening a hole or holes in a fastened component adjacent to the die by having the legs come to rest inside the fastened component, even when the fastened component adjacent to the die is a thin plate.

In another example of the present invention, the bottom surface of the die cavity is substantially flat and free of protrusions. Here, a plurality of uneven portions, such as the uneven portions 37 in FIG. 4, are formed over the entire flat portion of the bottom surface to increase the coefficient of friction.

Figure 9:
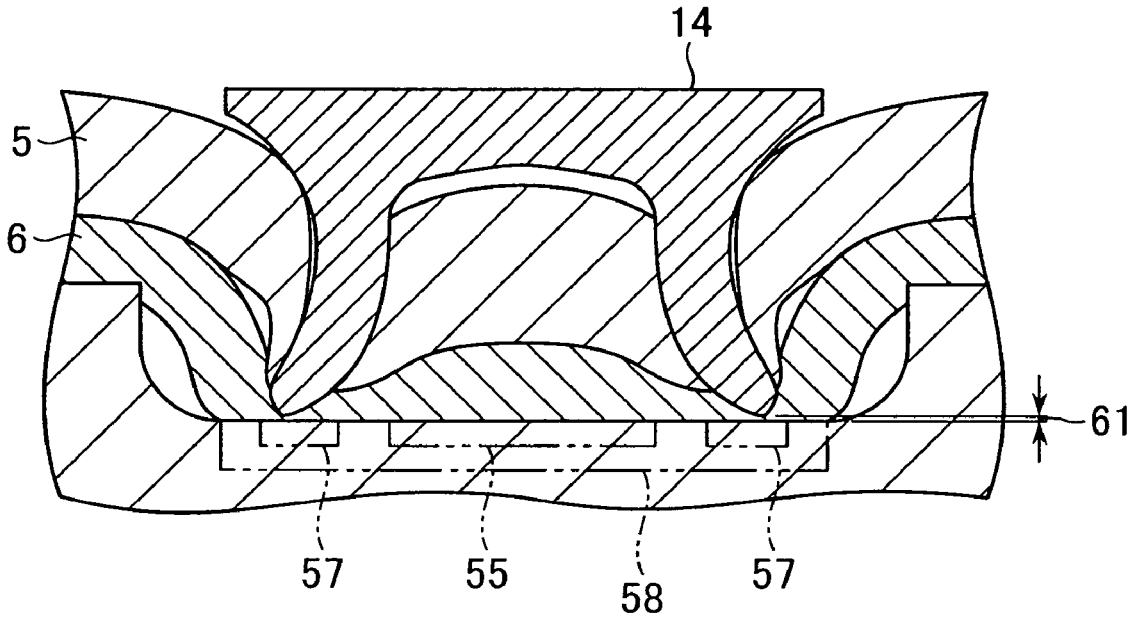
FIG. 9 is a cross-sectional view of a self-piercing rivet driven into fastened components showing portions considered for an increased coefficient of friction, where the die has a cavity without a protrusion.
Figure 10:
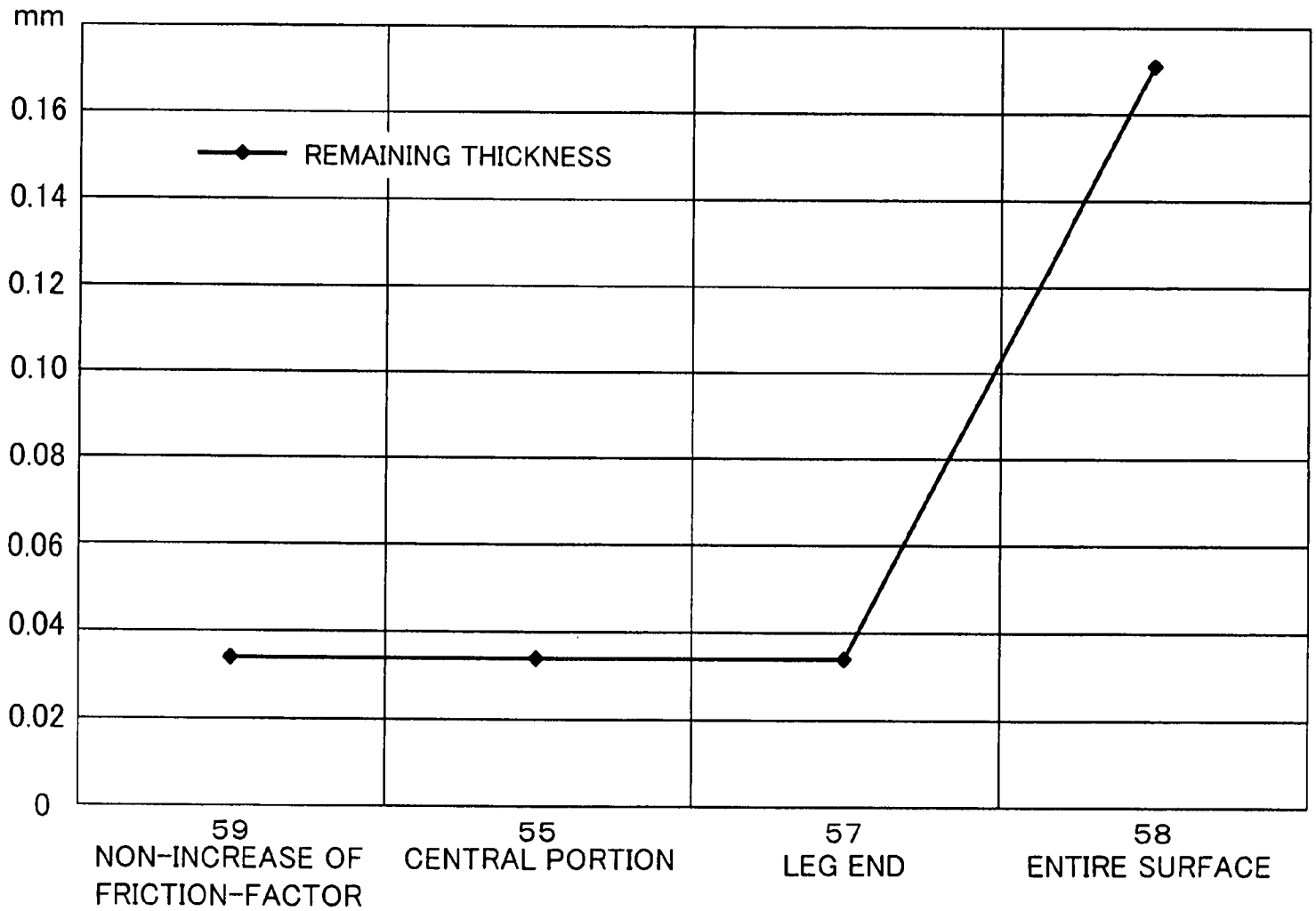
FIG. 10 is a graph showing remaining thickness of fastened components corresponding to the portions in FIG. 9.

The present inventor again performed a simulation in which the coefficient of friction (μ) was increased in various sections of the fastened component 6 and the inner surface of the cavity from 0.1 to 0.3. In this test, the inventor set out to determine whether he could maintain the remaining workpiece thickness between the tips of the legs of the self-piercing rivet and the bottom surface of the cavity. As indicated in FIG. 9, the coefficient of friction (μ) was increased from 0.1 to 0.3 at the center portion of the flat cavity 55, the leg tip portion 57 of the self-piercing rivets, and the entire bottom surface portion 58 including the center portion 55 and the leg tip portions 57. FIG. 10 is a graph showing the remaining workpiece thickness in the portion without an increase in the coefficient of friction 59, the central portion 55, the leg tip portion 57, and the entire bottom surface portion 58. The remaining workpiece thickness is the portion indicated by 61 in FIG. 9. It is clear from FIG. 10 that the remaining workpiece thickness is maintained sufficiently when the entire bottom surface portion 58 is roughened.

The unevenness for increasing the coefficient of friction is most effective when formed over the entire bottom surface portion. As a result, slippage is prevented or minimized inside the die cavity, and the fastened component is deformed correctly along the shape of the cavity even when press molding oil is adhering to a fastened component such as a body panel. Thus, the legs of a self-piercing rivet are prevented from opening a hole or holes in a fastened component by having the legs come to rest inside a fastened component adjacent to that die, even when the fastened component adjacent to the die is a thin plate.

In the present invention, the unevenness used to increase the coefficient of friction should preferably be formed on the protrusion inclined surface 35 or over the entire bottom surface 58 of the cavity. However, unevenness may not be required over the entire inclined or bottom surface. It may be formed over part of the surface as long as the unevenness sufficiently increases the coefficient of friction. If partial unevenness is the only option, then the uneven portions should be the protrusion inclined surface 35 or the bottom surface 58 of the cavity.

While preferred embodiments have been shown and described, changes can be made without departing from the principles and spirit of the invention, the scope of which is defined in the accompanying claims.

What is claimed is:

1. For use in a self-piercing rivet fastening device, a die having walls defining a cavity for receiving portions of components to be fastened when those portions are forced into the die cavity by legs of a self-piercing rivet driven by a punch, wherein predetermined surface portions of the die cavity walls have surface roughness that increases friction between the predetermined surface portions and corresponding portions of a fastened component adjacent to the die that contact the predetermined surface portions, wherein the die cavity walls have a central protrusion with inclined surfaces and the roughness is provided on the inclined surfaces to impede slippage between the inclined surfaces on which the roughness is provided and the corresponding portions of the fastened component.

2. For use in a self-piercing rivet fastening device, a die having walls defining a cavity for receiving portions of components to be fastened when those portions are forced into the die cavity by legs of a self-piercing rivet driven by a punch, wherein predetermined surface portions of the die cavity walls have surface roughness that increases friction between the predetermined surface portions and corresponding portions of a fastened component adjacent to the die that contact the predetermined surface portions, wherein the die cavity walls have a bottom surface and the roughness is provided on the bottom surface to impede slippage between the bottom surface and the corresponding portions of the fastened component.

3. A die according to claim 1, wherein the roughness is in the form of streaks extending in a direction to prevent said slippage.

4. A die according to claim 1, wherein the roughness is due to lathe or electric discharge processing.

5. For use in a self-piercing rivet fastening device, a die having walls defining a cavity for receiving portions of components to be fastened when those portions are forced into the die cavity by legs of a self-piercing rivet driven by a punch, wherein predetermined surface portions of the die cavity walls disposed to be contacted by corresponding component portions forced into the cavity have surface roughness that provides a coefficient of friction substantially greater than other surface portions of the die cavity walls to impede slippage between the predetermined surface portions and the corresponding component portions.

6. A die according to claim 5, wherein the predetermined surface portions of the die cavity walls are inclined surface portions of a die cavity wall protrusion.

7. A die according to claim 5, wherein the predetermined surface portions of the die cavity walls are portions of a bottom wall surface of the die.

* * * * *